US006895837B2

(12) United States Patent
Hsien

(10) Patent No.: US 6,895,837 B2
(45) Date of Patent: May 24, 2005

(54) WRENCH STRUCTURE HAVING A STRENGTHENED HANDLE

(76) Inventor: Chih-Ching Hsien, 58, Ma Yuan West St., Taichung (TW)

( * ) Notice: Subject to any disclaimer, the term of this patent is extended or adjusted under 35 U.S.C. 154(b) by 13 days.

(21) Appl. No.: 10/623,312

(22) Filed: Jul. 17, 2003

(65) Prior Publication Data

US 2005/0011316 A1 Jan. 20, 2005

(51) Int. Cl.[7] ..... B25B 13/02
(52) U.S. Cl. ..... 81/125.1; D8/28; 81/177.1
(58) Field of Search ..... 81/125.1, 124.3, 81/177.1, 124.4; D8/28

(56) References Cited

U.S. PATENT DOCUMENTS 1,793,714 A * 2/1931 Newberg ..... 81/125.1
5,172,614 A * 12/1992 Monnet et al. ..... 81/125.1
5,492,040 A * 2/1996 Bellas ..... 81/125.1
D434,292 S * 11/2000 Hsieh ..... D8/28
D481,276 S * 10/2003 Hu ..... D8/28
D494,833 S * 8/2004 Macor ..... D8/107
D496,238 S * 9/2004 Hsien ..... D8/28
6,792,833 B2 * 9/2004 Macor ..... 81/125.1

* cited by examiner

*Primary Examiner*—Debra Meislin

(57) ABSTRACT

A wrench structure includes a wrench body having a handle portion. The handle portion is formed with a reinforcement portion having a first side formed with a first holding portion and a second side formed with a second holding portion. The first holding portion has a plane vertical to that of the second holding portion. Thus, the user's hand and the holding portion of the wrench body have a larger contact area, so that the holding portion of the wrench body can apply a larger force and torque to drive and rotate the workpiece, such as the nut or the like.

9 Claims, 6 Drawing Sheets

WRENCH STRUCTURE HAVING A STRENGTHENED HANDLE

BACKGROUND OF THE INVENTION

1. Field of the Invention

The present invention relates to a wrench structure, and more particularly to a wrench structure having a strengthened handle.

2. Description of the Related Art

A conventional wrench in accordance with the prior art shown in FIG. 8 comprises a handle 20 having a first end provided with a closed driving head 22, and a second end provided with an opened driving head 24. Thus, the handle 20 can be driven to rotate the closed driving head 22 or the opened driving head 24 so as to drive and rotate the workpiece, such as the nut or the like.

However, the thumb of the user's hand is rested on the narrower portion of the handle 20 during operation, so that the user's hand and the handle 20 have a smaller contact area, thereby decreasing the driving force and torque applied by the handle 20. In addition, the thumb of the user's hand is rested on the narrower portion of the handle 20, so that the user's hand easily feels uncomfortable during operation.

SUMMARY OF THE INVENTION

The primary objective of the present invention is to provide a wrench structure, wherein the user's hand and the holding portion of the wrench body have a larger contact area, so that the holding portion of the wrench body can apply a larger force and torque to drive and rotate the workpiece, such as the nut or the like.

Another objective of the present invention is to provide a wrench structure, wherein the wrench body is integrally formed with the first holding portion, the second holding portion and the reinforcement portion, so that the whole length of the wrench body has the same structural strength, thereby enhancing the structural strength of the wrench body during operation.

A further objective of the present invention is to provide a wrench structure, wherein the handle portion of the wrench body is integrally formed with the reinforcement portion so as to strengthen the structural strength of the handle portion.

A further objective of the present invention is to provide a wrench structure, wherein the reinforcement portion has an enlarged diameter, so that when the user's hand holds the first holding portion or the second holding portion, the thumb of the user's hand is rested on the reinforcement portion, thereby preventing the user's hand from slipping on the handle portion.

A further objective of the present invention is to provide a wrench structure, wherein the thumb of the user's hand is rested on the reinforcement portion, thereby enhancing the driving force, so that the holding portion of the wrench body can apply a larger force and torque to drive and rotate the workpiece.

In accordance with the present invention, there is provided a wrench structure, comprising a wrench body having a handle portion, wherein:

the handle portion is formed with a reinforcement portion;

the reinforcement portion has a first side formed with a first holding portion and a second side formed with a second holding portion; and the first holding portion has a plane inclined with that of the second holding portion.

Further benefits and advantages of the present invention will become apparent after a careful reading of the detailed description with appropriate reference to the accompanying drawings.

DETAILED DESCRIPTION OF THE INVENTION

Figure 1:
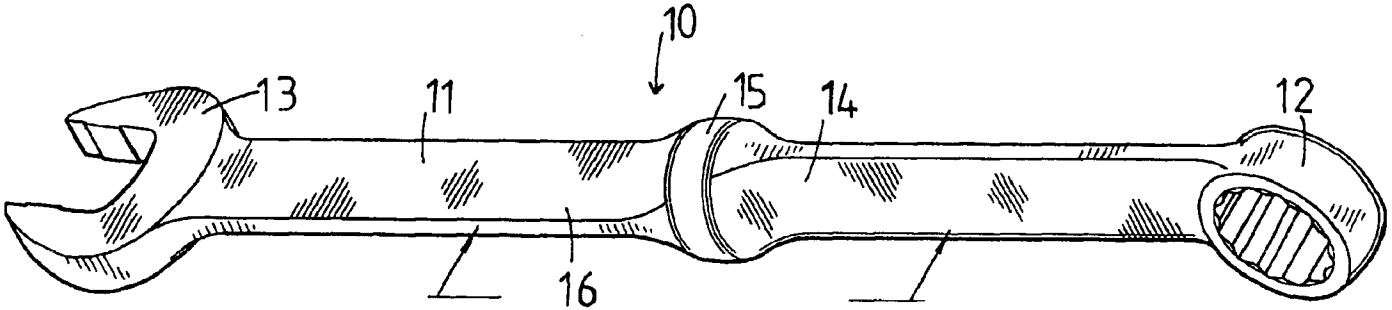
FIG. 1 is a perspective view of a wrench structure in accordance with the preferred embodiment of the present invention.
Figure 2:
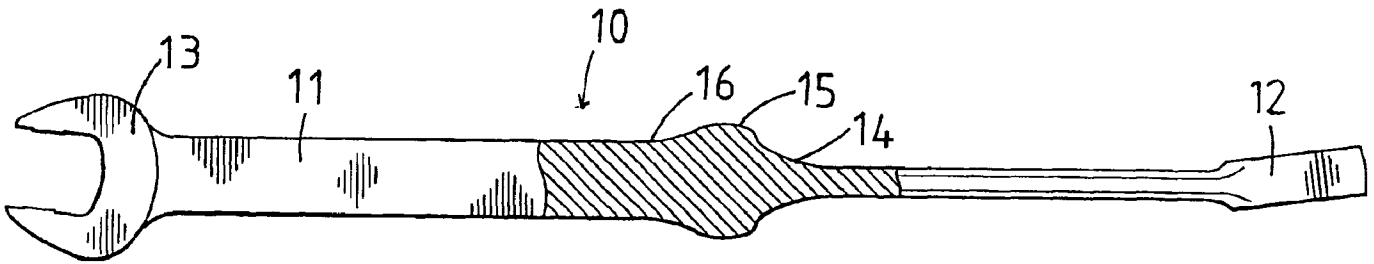
FIG. 2 is a top plan partially cross-sectional view of the wrench structure as shown in FIG. 1.

Referring to the drawings and initially to FIGS. 1 and 2, a wrench structure in accordance with the preferred embodiment of the present invention comprises a wrench body 10 having a handle portion 11.

The handle portion 11 has a mediate section formed with a reinforcement portion 15. The reinforcement portion 15 has an enlarged diameter so as to strengthen the structural strength of the handle portion 11. The reinforcement portion 15 has a first side formed with a first holding portion 14 and a second side formed with a second holding portion 16. Preferably, the first holding portion 14 has a plane inclined with that of the second holding portion 16. Preferably, the first holding portion 14 has a plane vertical to that of the second holding portion 16.

In addition, the first holding portion 14 has a distal end provided with a closed driving head 12, and the second holding portion 16 has a distal end provided with an opened driving head 13.

Preferably, the wrench body 10 is integrally formed with the reinforcement portion 15, the first holding portion 14 and the second holding portion 16 by a forging process.

In fabrication, the handle portion 11 of the wrench body 10 is integrally formed with the first holding portion 14 at one end thereof, the second holding portion 16 at the other end thereof, and the reinforcement portion 15 between the first holding portion 14 and the second holding portion 16 during the forging process.

Thus, the wrench body 10 is integrally formed with the first holding portion 14, the second holding portion 16 and the reinforcement portion 15 by the forging process, so that the whole length of the wrench body 10 has the same structural strength, thereby enhancing the structural strength of the wrench body 10 during operation.

In addition, the first holding portion 14 has a plane vertical to that of the second holding portion 16, so that the user's hand can hold the plane of the first holding portion 14 to drive the second holding portion 16 as shown in FIG. 1, and can hold the plane of the second holding portion 16 to drive the first holding portion 14 as shown in FIG. 2. Thus, the user's hand and the holding portion of the wrench body 10 have a larger contact area, so that the holding portion of the wrench body 10 can apply a larger force and torque to drive and rotate the workpiece, such as the nut or the like.

Further, the handle portion 11 of the wrench body 10 is integrally formed with the reinforcement portion 15 so as to strengthen the structural strength of the handle portion 11.

Further, the reinforcement portion 15 has an enlarged diameter, so that when the user's hand holds the first holding portion 14 or the second holding portion 16, the thumb of the user's hand is rested on the reinforcement portion 15, thereby preventing the user's hand from slipping on the handle portion 11.

Further, the thumb of the user's hand is rested on the reinforcement portion 15, thereby enhancing the driving force, so that the holding portion of the wrench body 10 can apply a larger force and torque to drive and rotate the workpiece.

Figure 3:
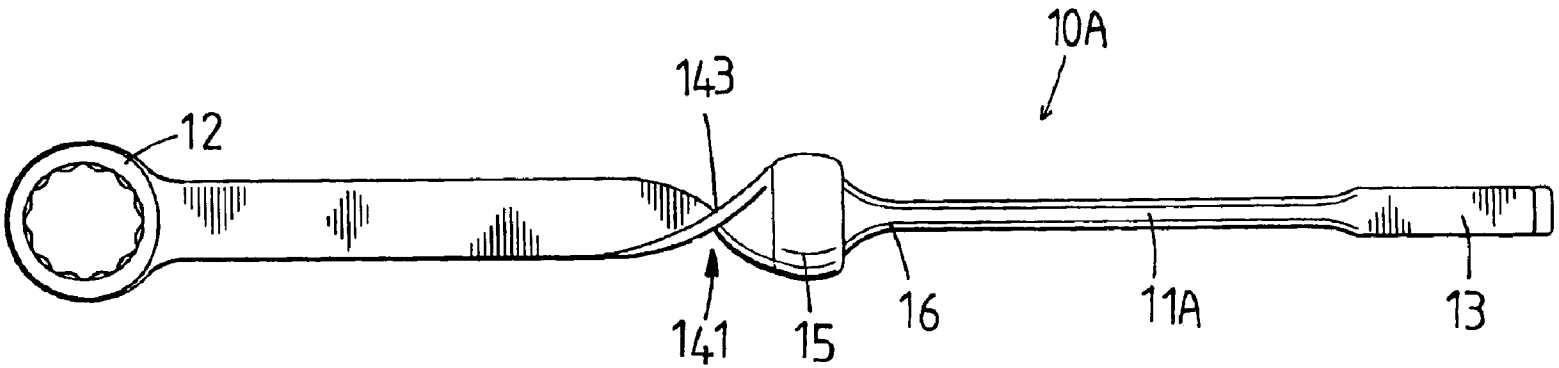
FIG. 3 is a plan view of a wrench structure in accordance with another embodiment of the present invention.
Figure 4:
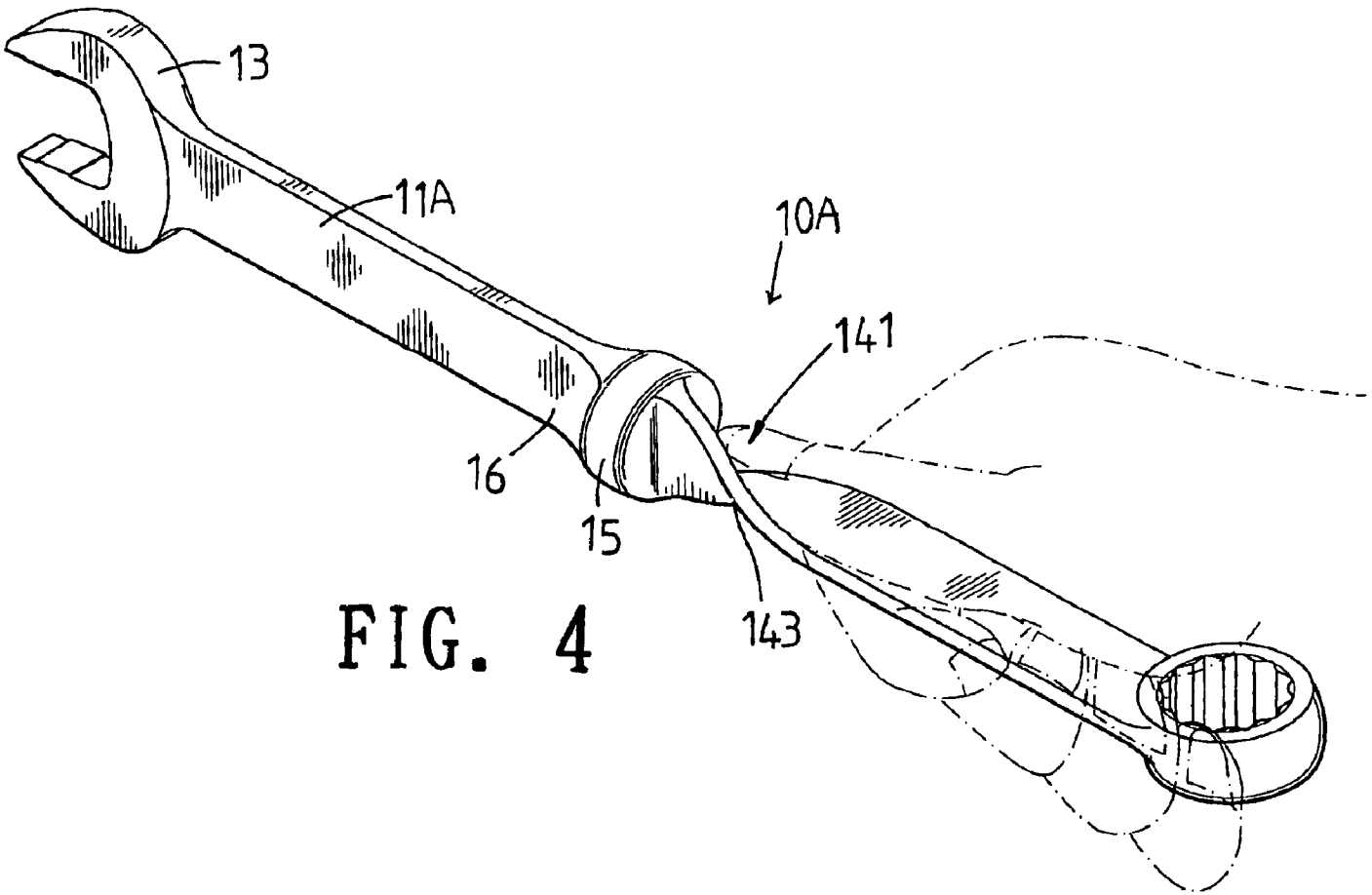
FIG. 4 is a perspective operational view of the wrench structure as shown in FIG. 3.
Figure 5:
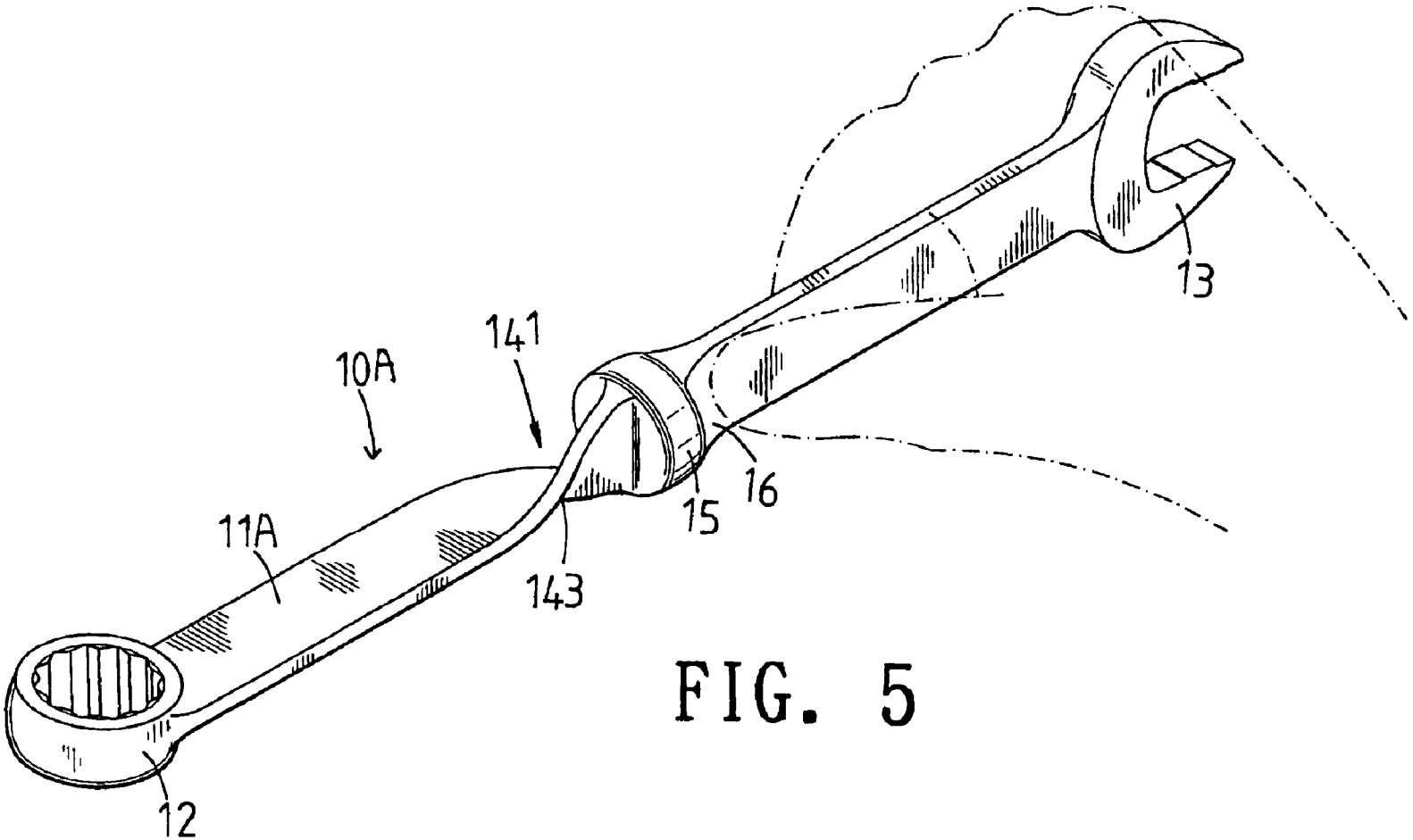
FIG. 5 is a perspective operational view of the wrench structure as shown in FIG. 3.

Referring to FIGS. 3–5, a wrench structure in accordance with another embodiment of the present invention is shown, wherein the reinforcement portion 15 of the handle portion 11A of the wrench body 10A has a first side formed with a first holding portion 141 and a second side formed with a second holding portion 16. The first holding portion 141 has a bent portion 143 located adjacent to the reinforcement portion 15, so that the first holding portion 14 has a plane vertical to that of the second holding portion 16.

In fabrication, the handle portion 11A of the wrench body 10A is integrally formed with the reinforcement portion 15. Then, one end of the handle portion 11A is bent through ninety degrees to form the bent portion 143, so that the handle portion 11A of the wrench body 10A is formed with the first holding portion 141 and the second holding portion 16, with the reinforcement portion 15 located between the first holding portion 141 and the second holding portion 16.

In operation, as shown in FIG. 4, when the user's hand holds the first holding portion 14, the thumb of the user's hand is rested on the bent portion 143 of the first holding portion 141, thereby enhancing the driving force of the wrench. Alternatively, as shown in FIG. 5, the thumb of the user's hand is rested on the plane of the second holding portion 16.

Figure 6:
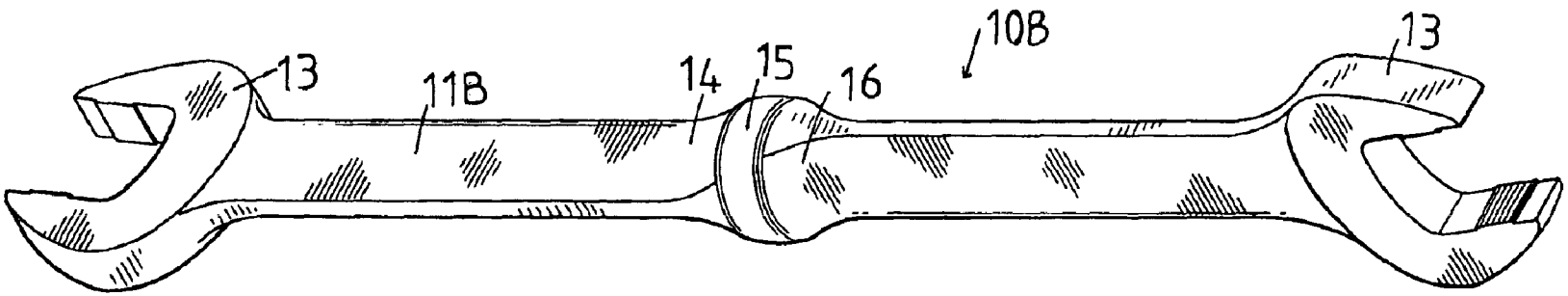
FIG. 6 is a perspective view of a wrench structure in accordance with another embodiment of the present invention.

Referring to FIG. 6, a wrench structure in accordance with another embodiment of the present invention is shown, wherein the handle portion 11B of the wrench body 10B has two distal ends each formed with an opened driving head 13.

Figure 7:
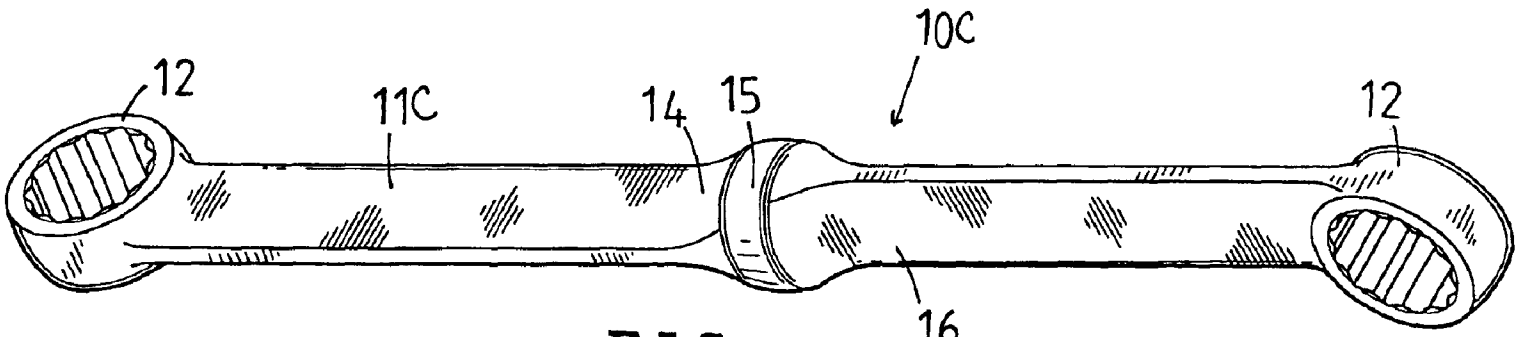
FIG. 7 is a perspective view of a wrench structure in accordance with another embodiment of the present invention.
Figure 8:
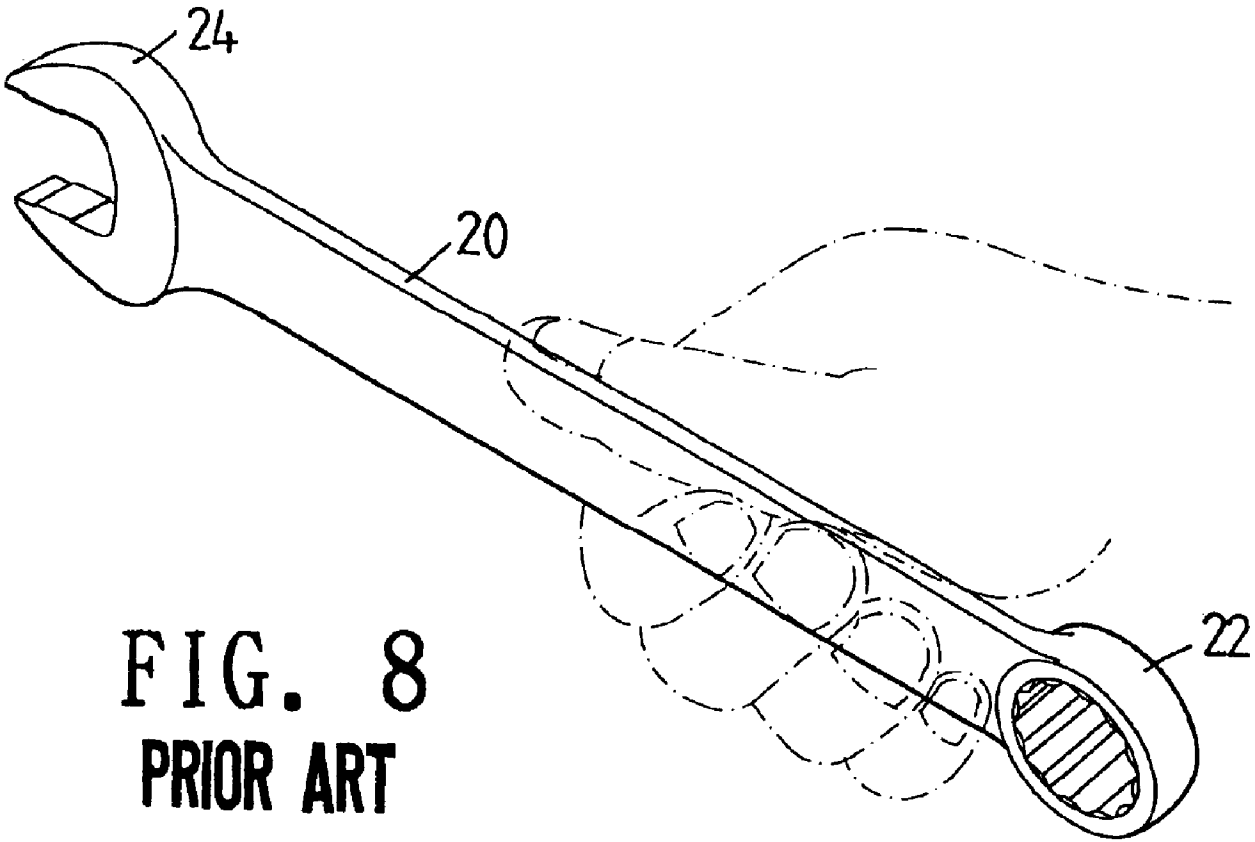
FIG. 8 PRIOR ART
FIG. 8 is a perspective view of a conventional wrench in accordance with the prior art.

Referring to FIG. 7, a wrench structure in accordance with another embodiment of the present invention is shown, wherein the handle portion 11C of the wrench body 10C has two distal ends each formed with a closed driving head 12.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A wrench structure, comprising a wrench body having a handle portion, wherein:

the handle portion is formed with a reinforcement portion;

the reinforcement portion has a first side formed with a first holding portion and a second side formed with a second holding portion;

the first holding portion has a plane inclined with that of the second holding portion;

the first holding portion has a bent portion located adjacent to the reinforcement portion.

2. The wrench structure in accordance with claim 1, wherein the reinforcement portion has an enlarged diameter to strengthen the structural strength of the handle portion.

3. The wrench structure in accordance with claim 1, wherein the plane of the first holding portion is vertical to that of the second holding portion.

4. The wrench structure in accordance with claim 1, wherein the wrench body is integrally formed with the reinforcement portion, the first holding portion and the second holding portion.

5. The wrench structure in accordance with claim 1, wherein the first holding portion has a distal end provided with a closed driving head.

6. The wrench structure in accordance with claim 1, wherein the second holding portion has a distal end provided with an opened driving head.

7. The wrench structure in accordance with claim 1, wherein the plane of the first holding portion is vertical to that of the second holding portion by the bent portion.

8. The wrench structure in accordance with claim 1, wherein the handle portion of the wrench body has two distal ends each formed with an opened driving head.

9. The wrench structure in accordance with claim 1, wherein the handle portion of the wrench body has two distal ends each, formed with a closed driving head.

* * * * *